US005399134A

United States Patent [19]

Abboudi et al.

[11] Patent Number: 5,399,134

[45] Date of Patent: Mar. 21, 1995

[54] STAIR CLIMBING EXERCISE APPARATUS

[76] Inventors: Shalom Y. Abboudi, 126 N. 9th Ave., Highland Park, N.J. 08904; Robert Adley, 18 Mendingwall Cir., Madison, Conn. 06443

[21] Appl. No.: 176,017

[22] Filed: Dec. 30, 1993

[51] Int. Cl.[6] ..... A63B 23/04; A63B 21/20

[52] U.S. Cl. ..... 482/52; 482/111

[58] Field of Search ..... 482/51, 52, 53, 54, 482/70, 111, 112

[56] References Cited

U.S. PATENT DOCUMENTS 4,776,581 10/1988 Shepherdson ..... 482/54
5,050,863 9/1991 Yacoboski ..... 482/111
5,116,295 5/1992 Dunn et al. ..... 482/111
5,123,641 6/1992 Abboudi et al. ..... 482/111
5,163,886 11/1992 Seol ..... 482/52
5,217,420 6/1993 Abboudi et al. ..... 482/70

*Primary Examiner*—Stephen R. Crow
*Attorney, Agent, or Firm*—Henry I. Schanzer

[57] ABSTRACT

An exercise apparatus, particularly useful for in-water use, comprises a frame having, at its front end, a pair of side by side inclined tracks. A pair of steps are mounted for movement along respective ones of the tracks. A seating member includes a horizontal seat secured to the frame by a mechanism allowing selective positioning of the seat in front of the steps, whereby a user can operate the steps while seated, or to one side of the steps, whereby the steps are accessible by a user for performing a conventional stair climbing exercise.

13 Claims, 2 Drawing Sheets

STAIR CLIMBING EXERCISE APPARATUS

BACKGROUND OF THE INVENTION

This invention relates to exercise apparatus, and particularly to apparatus for performing a variation of a stair climbing activity.

Stair climbing exercise apparatus are known. For example, such apparatus is described in Applicant's pending application, Ser. No. 07/934,007 titled Underwater Stair Climbing Exercise Apparatus, the teachings of which are incorporated herein by reference. Typically, the apparatus comprise a pair of horizontal steps mounted for alternate vertical movements, e.g., along a track inclined slightly from the vertical. The steps can be interconnected by means of a cable wound around a pulley at the top of the track, whereby, when one of the steps is driven downward by a user, the other step is pulled up the track. Typically, variable resistance means may be provided for adjusting the amount of force required to move the steps downward. An example of such means is an adjustable brake shoe engaging the pulley driven by the step connecting cable. Another example of such means is extending the surface area of the step.

Stair climbing activates almost all the muscles of the lower limb. In pushing the steps downwards, the most active group of muscles includes the hip extensors, namely the gluteus maximus and hamstring, as well as the knee extensor, namely the quadriceps muscle. The hip flexors are activated to raise the lower limb to the next higher level.

A problem with known stair climbing apparatus is that the degree of exercising of the various muscles is a function of the weight of the exerciser. Stair climbing units on land utilize a computer to compensate for the weight of the exerciser and his weight advantage in pushing the steps down. Similarly, when stair climbing is performed in water, while maintaining an upright position, the weight of the exerciser, though decreased due to the buoyancy of the water, still helps to push the steps down. The use of a computer in underwater apparatus is clearly impractical, and a need thus exists for weight compensation in underwater stair climbing apparatus.

SUMMARY OF THE INVENTION

Applicants invention resides in part in the recognition that when stair climbing is performed while seated, the weight of the exerciser is neutralized, thus ensuring a more intensive exercise of the lower limbs. Moreover, for reasons of cost effectiveness and better utilization of space, it is desirable that stair climbing types of exercises whether performed standing or seated, should be performed on the same apparatus. This is achieved in accordance with this invention.

A stair climbing exercise apparatus embodying the invention comprises a pair of steps which are alternately movable downwardly in response to alternate downwardly thrusting movements of a user's legs. A seat is mounted on the frame of the apparatus and movable with respect thereto for alternatively positioning the seat facing towards the steps and in operable relationship therewith or disposed to one side of the steps, away from the step, and unusable therewith. In a first, step facing position of the seat, a user sits on the seat and engages his feet with each of the steps in turn for successively forcing the steps downwardly. In a second, seat out-of-the way position, the steps can be accessed by a standing user and the apparatus can be used in a conventional stair climbing activity. In the second out-of-the way position, two individuals can utilize the exercise unit simultaneously; one using it for a conventional stair climbing activity and the other using the seat as an independent exercise station while seated partially submerged in the water.

DESCRIPTION OF PREFERRED EMBODIMENTS OF THE INVENTION

Figure 3:
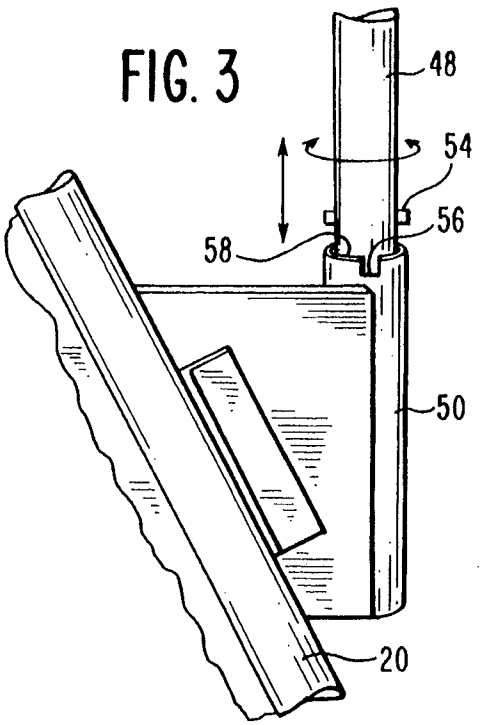
FIG. 3 is a partial view, on an enlarged scale, showing a means for adjusting the position of the seat with respect to the steps.

The apparatus illustrated herein is a variation of a known stair climbing exercise apparatus useable in a pool of water, an example of such apparatus being shown in pending application Ser. No. 07/934,007, the subject matter of which is incorporated herein by reference.

The apparatus 10 comprises a frame formed from various tubular posts providing legs 16 and interconnecting braces 18 for the legs 16. Two parallel, inclined posts 20 form the "front" of the apparatus (i.e., looking from left to right in FIG. 1) and the posts 20 support therebetween four elongated channel members 22 (FIG. 2) each having a U-shaped cross section. Each pair of channel members 22 defines a vertical track. A pair of horizontal steps 24 are provided which are mounted on rollers with the rollers extending into the channels of the channel members whereby the steps are movable along the tracks. The two steps 24 are interconnected by a cable (not illustrated) extending around a pulley mounted at the upper end of the tracks.

For providing resistance to movements of the steps 24, each step has mounted thereon a large flap 26, the area of which is selectively variable by adjusting the amount of overlap of two flat plates 28 and 30 forming each flap.

As noted, the apparatus is intended for use within a pool of water, and the interaction of the flaps with the water provides resistance to movement of the flaps and the steps connected thereto.

To the extent so far described, the apparatus is substantially identical to the apparatus shown in the above-cited pending application Ser. No. 07/934,007. For this reason, a more detailed description and illustration of the apparatus are not provided.

Also, to the extent so far described, the apparatus is sufficiently complete to be usable in conventional fashion, i.e., by a person standing upright in position to climb the movable steps.

In accordance with this invention, however, the apparatus includes a seating member 40 which is movable with respect to the tracks whereby, in one position of the seating member, the apparatus can be operated by a user sitting in front of the tracks.

The seating member 40 comprises a horizontal seat 42 secured to a horizontal tubular collar 44 slidably mounted on a horizontal bar 46 of an L-shaped seat support. The seat support includes a vertical bar 48 which extends into a vertical tubular post 50 rigidly secured to one of the inclined posts 20 of the apparatus frame. Means are provided whereby the position of the seat 42 can be adjusted with respect to the tracks.

Thus, for adjusting the height of the seat 42, the support vertical bar 48 has a number of vertically spaced apart horizontal holes 52 therethrough. A pin 54 (FIG. 3) is provided which can be passed through a selected hole 52 in the post, which pin 54 is receivable in one of two pairs of diametrically opposed slots 56 in the upper end 58 of the vertical post 50. In FIG. 3, only one slot of one slot pair 56 is shown. The other pair of slots is at 90° to the slot shown. The pin 54, when within one of the pair of slots 56, determines the vertical position of the seat in accordance with the selected hole 52 through which the pin 54 has been inserted. For providing support for the weight of the seat, as well as that of a user sitting on the seat, a vertical, adjustable length support post 57 is provided. The length of the post can be adjusted by known means. For example, the post 57 can comprise two segments (not illustrated) which telescope, one within the other, and which are held in position using, for example, a pin-slot arrangement such as shown in FIG. 3.

Figure 2:
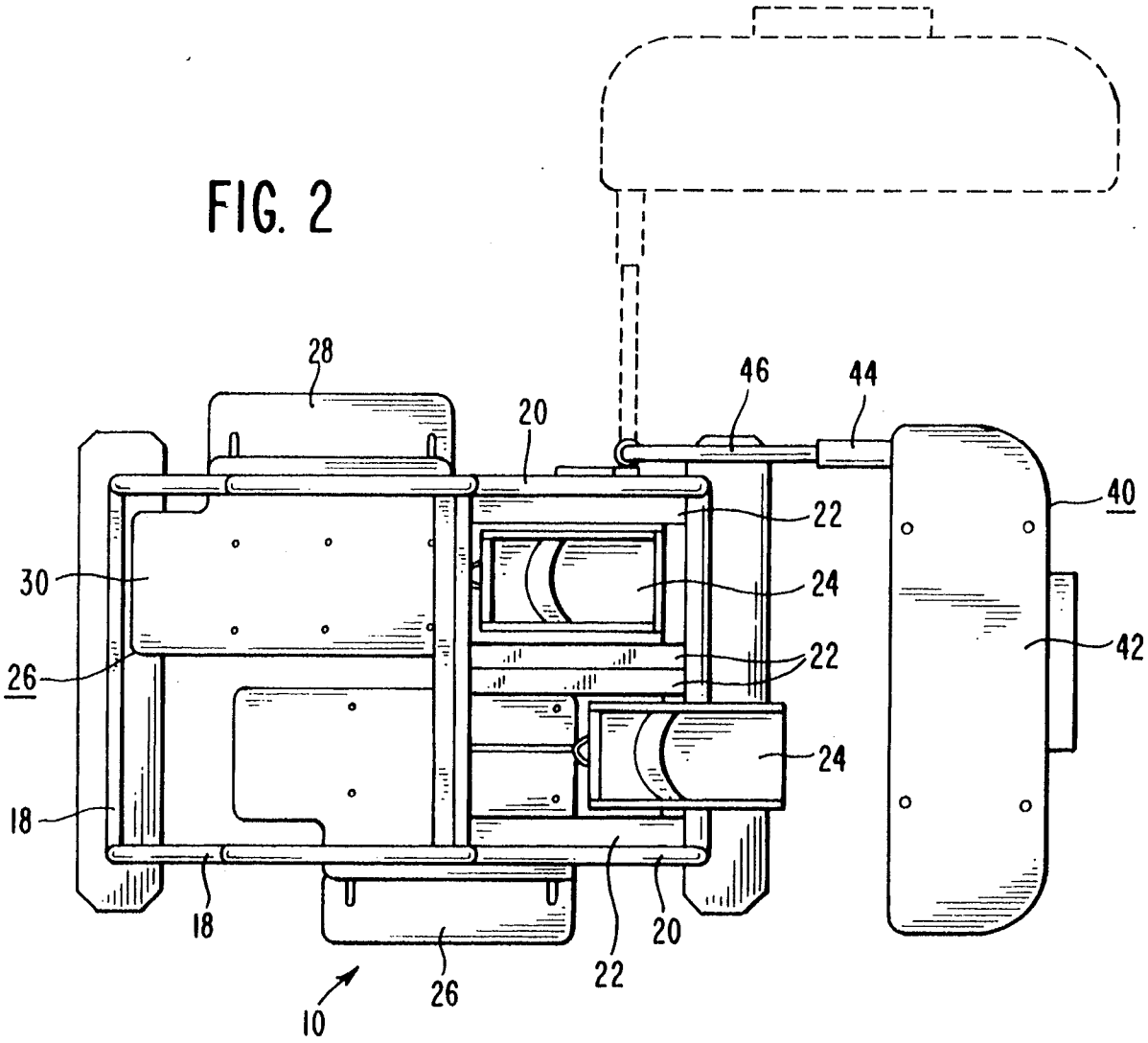
FIG. 2 is a plan view of the apparatus.

By lifting the seat 42 so as to raise the pin 54 out of a pair of slots 56, the bar 48 can be rotated with respect to the post 50 for rotating the seat from the position shown in solid lines in FIG. 2, that is, disposed in front of the steps 24, through 90° to a position shown in dashed lines, that is, disposed to one side of the steps 24. The pin 54 through the vertical support bar 48 is then lowered into the other pair of slots in the tubular post for retaining the seat in its displaced position.

Figure 1:
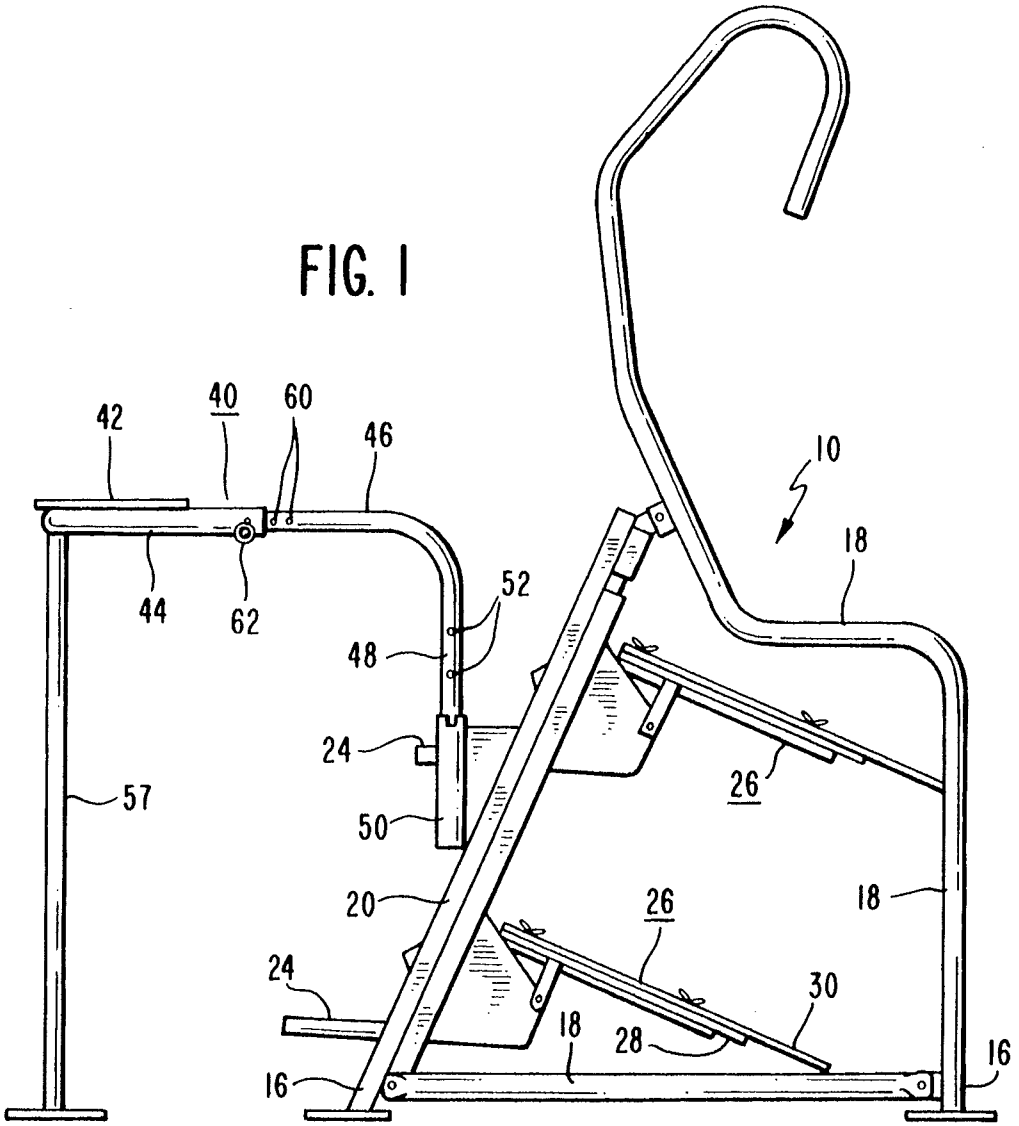
FIG. 1 is a side elevation of a stair climbing apparatus according to this invention.

The horizontal distance of the seat relative to the tracks is likewise adjustable by means of horizontally spaced apart holes 60 as shown in FIG. 1, through the horizontal support bar 46 and a cooperating pin 62 mounted on and extending through a pair of diametrically opposed holes through the seat supporting collar 44.

Thus, as previously explained, depending upon the position of the seat 42 with respect to the tracks, the apparatus can be used by a person in an upright position, in a conventional stair climbing exercise, or by a person sitting on the seat and facing towards the steps, in an exercise resembling a bicycling exercise. As previously noted, the actual muscles exercised and the extent of effort required from the different muscles varies with the particular exercise performed.

Perhaps a slightly more accurate description is that in the out-of-the way position (dashed lines) of the seat, the user performs a stair climbing activity, whereas in the seated position, the user performs a pedal pressing activity.

In the seated position, the user must push the steps of the stair climber using his leg muscles without significant benefit of his own weight in helping to push the steps down. Thus, in the seated position, a higher level of exercising of the leg muscles is obtained.

In the apparatus described, the steps are disposed for movements along inclined tracks. The steps, however, can be simply the ends of a pair of side by side elongated members pivoted about a common axle. An example of such construction is shown in U.S. Pat. No. 5,116,295, the subject matter of which is incorporated herein by reference.

The apparatus of the invention is intended for use in a body of water, such as a pool, to provide the user the benefits of exercising in a more supportive and less stressing environment, due to the buoyancy and lubricative properties of the water. An apparatus in accordance with the invention enables more efficient use of the very limited space normally available in a pool since a single piece of equipment provides for either stair climbing or leg pressing. Also, the same piece of equipment can be used by two individuals, independently, when one individual is using the apparatus for stair climbing and the other is using the seat for other underwater exercises.

As described in pending application 07/934,007, the user can control the size of the flaps 26 and the rate at which he pushes down on the steps 24. The user, whether seated or standing, can control the level of stress to which he is subjected. Thus, the equipment embodying the invention is highly suited for increasing the fitness of the exerciser and to perform therapeutic exercises for, among others, knee rehabilitation following injury or surgery.

What is claimed is:

1. An exercise apparatus for use within a body of water comprising a frame on which are formed two parallel adjacent tracks inclined from the vertical, the two tracks having a lower end and an upper end with the lower end of the parallel tracks being intended to rest on the bottom of the body of water and the upper end of the parallel tracks extending above the bottom, two steps and guide means one step per track, said steps being reciprocally movable along adjacent paths defined by said tracks, means interconnecting said two steps, upon movement of one of said steps downwardly in response to a force exerted thereon by a user of the device, the other of said steps is moved upwardly, and each of said steps having a surface disposed generally perpendicular to the direction of movements of said steps, whereby in use of said device within a body of water, the water provides resistance to movements of said steps along said direction; and a seating member mounted on said frame including a seat, and means for selectively positioning said seat in operative relationship with said steps, whereby, in a first position of said seat adjacent to said steps, a user seated on said seat can engage and force said steps downwardly with his feet thereby reducing the effect of the user's weight, or in a second position of said seat displaced with respect to said steps, a user in upright stance can access said steps for performing an activity akin to stair climbing.

2. An apparatus according to claim 1, including means for selectively adjusting the vertical and horizontal position of said seat relative to said steps.

3. An apparatus according to claim 2, including a vertically adjustable mechanism for supporting the weight of said seat in any selected position thereof.

4. In combination, a body of water and an exercise apparatus for use within said body of water, said apparatus comprising a frame on which are formed two parallel adjacent tracks inclined from the vertical, the two tracks having a lower end and an upper end with the lower end of the parallel tracks being intended to rest on the bottom of the body of water and the upper end of the parallel tracks extending above the bottom, two steps and guide means one step per track, said steps being reciprocally movable along adjacent paths defined by said tracks, means interconnecting said two steps, upon movement of one of said steps downwardly in response to a force exerted thereon by a user of the device, the other of said steps is moved upwardly, and each of said steps having a surface disposed generally perpendicular to the direction of movements of said steps, whereby in use of said device within a body of water, the water provides resistance to movements of said steps along said direction; a seating member mounted on said frame including a seat, and means for selectively positioning said seat in operative relationship with said steps, whereby, in a first position of said seat adjacent to said steps, a user seated on said seat can engage and force said steps downwardly with his feet, or in a second position of said seat displaced with respect to said steps, a user in upright stance can access said steps for performing a stair climbing activity.

5. An apparatus according to claim 4, including means for selectively adjusting the vertical and horizontal position of said seat relative to said steps.

6. An apparatus according to claim 5, including a vertically adjustable mechanism for supporting the weight of said seat in any selected position thereof.

7. The exercise apparatus as claimed in claim 1 wherein a flap means is mounted on each step extending laterally from each step for increasing resistance to movement of the steps in water.

8. An exercise apparatus according to claim 1 wherein said seating member when placed in said second position enables one user to use the steps for performing an activity akin to stair climbing and enabling another user to concurrently make independent use of the seating member.

9. In the combination as claimed in claim 4, the exercise apparatus as claimed in claim 1 wherein a flap means is mounted on each step extending laterally from each step for increasing resistance to movement of the steps in water.

10. In the combination as claimed in claim 4, an exercise apparatus according to claim 1 wherein said seating member when placed in said second position enables one user to use the steps for performing an activity akin to stair climbing and enabling another user to concurrently make independent use of the seating member.

11. An exercise apparatus comprising a frame, a pair of steps mounted on the frame for alternating up and down movement, a seating member mounted on said frame including a seat, and means for selectively positioning said seat in operative relationship with said steps, said seating member and seat, and said means for selectively positioning said seat, including a horizontal member extending from said frame for supporting the seat and said horizontal member resting on a vertical pole rotatably mounted on said frame for enabling the seat member to be rotated about the frame while being supported by said vertical and horizontal members whereby, in a first position of said seat adjacent to said steps, a user seated on said seat can engage and force said steps downwardly with his feet, or in a second position said seat is displaced with respect to said steps, and a user in upright stance can access said steps for performing a stair climbing activity.

12. An apparatus according to claim 11, including means for selectively adjusting the vertical and horizontal position of said seat relative to said steps.

13. An apparatus according to claim 12, including a vertically adjustable mechanism for supporting the weight of said seat in any selected position thereof.

* * * * *